United States Patent [19]

Schexnayder

[11] 3,960,059

[45] June 1, 1976

[54] FAST EXHAUST CIRCUIT FOR HYDRAULIC JACKS

[75] Inventor: Lawrence F. Schexnayder, Joliet, Ill.

[73] Assignee: Caterpillar Tractor Co., Peoria, Ill.

[22] Filed: Dec. 9, 1974

[21] Appl. No.: 530,621

[52] U.S. Cl. ..... 91/443; 91/450; 91/461

[51] Int. Cl.[2] ..... F15B 11/04

[58] Field of Search ..... 91/461, 443, 449, 450, 91/451, 304, 468; 137/596.14, 596.15, 596.16

[56] References Cited

UNITED STATES PATENTS

| | | | |
|---|---|---|---|
| 3,171,331 | 3/1965 | Samuel | 91/443 X |
| 3,455,209 | 7/1969 | Preston et al. | 91/443 X |
| 3,494,258 | 2/1970 | Harms et al. | 91/451 X |
| 3,557,829 | 1/1971 | Finley | 91/461 X |
| 3,805,678 | 4/1974 | Bianchetta et al. | 91/461 X |
| 3,840,049 | 10/1974 | Field, Jr. | 137/596.15 X |
| 3,847,060 | 11/1974 | Jasinski et al. | 91/461 X |

FOREIGN PATENTS OR APPLICATIONS

| | | | |
|---|---|---|---|
| 1,106,054 | 5/1961 | Germany | 60/484 |

*Primary Examiner*—Carlton R. Croyle
*Assistant Examiner*—Edward Look
*Attorney, Agent, or Firm*—John W. Grant

[57] ABSTRACT

A fast exhaust circuit for hydraulic jacks includes a bypass conduit communicating a hydraulic jack with a tank, and a bypass valve disposed in the bypass conduit normally positioned for blocking fluid flow therethrough so that all fluid exhausted from the hydraulic jack passes through and is modulatably controlled by a control valve with the bypass valve being selectively positionable for returning a greater portion of the exhausted fluid directly to the tank and bypassing the control valve.

6 Claims, 1 Drawing Figure

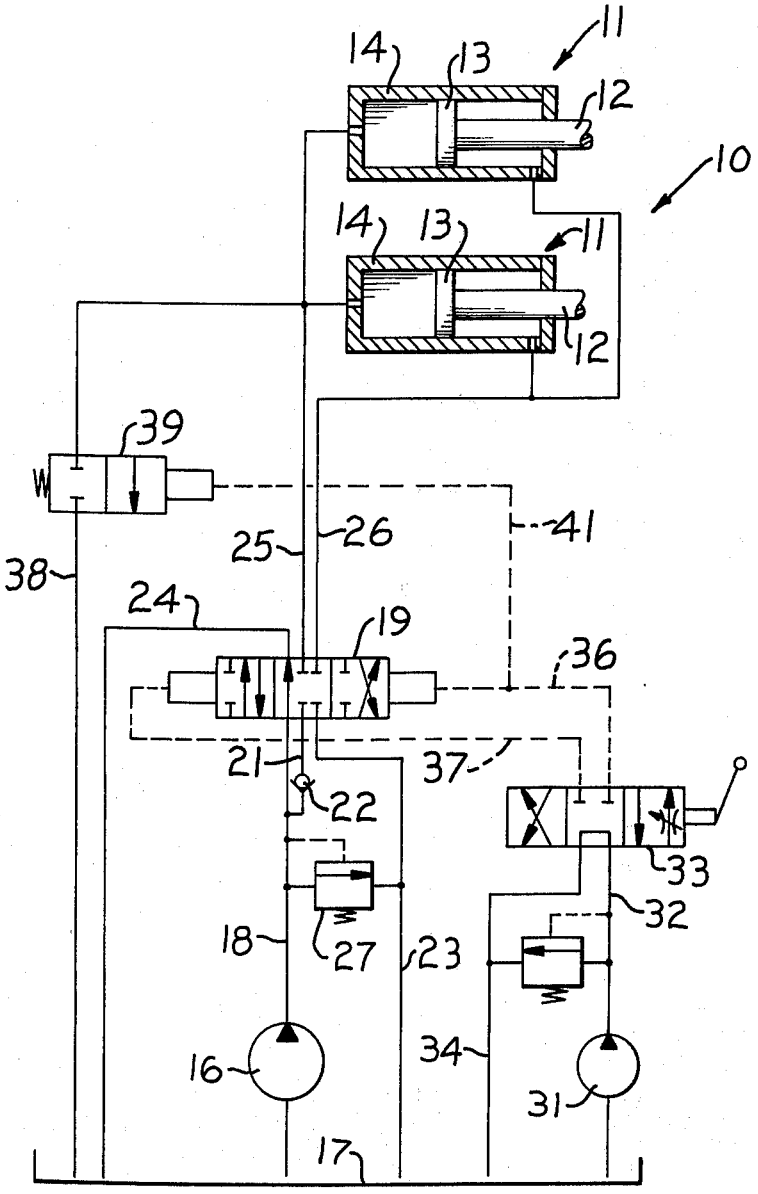
11
14
13
12
10
14
13
11
12
39
41
25
26
38
24
19
36
21
37
22
33
32
18
27
23
16
34
31
17

FAST EXHAUST CIRCUIT FOR HYDRAULIC JACKS

BACKGROUND OF THE INVENTION

A hydraulic jack commonly has its opposite ends in fluid communication with a control valve which is selectively positionable to direct pressurized fluid from a pump to one end of the hydraulic jack with the fluid exhausted from the opposite end being returned to a tank through the control valve. Normally, the size of the control valve is selected to match the pump output. However, one of the problems frequently encountered with such an arrangement is that the piston rod of the hydraulic jack is attached to one side of the piston and creates unequal actuating areas and displacement volumes on opposite sides of the piston. Thus, when actuating fluid is directed to the rod side of the piston for retracting the hydraulic jack, a substantially greater volume of fluid is exhausted from the head end side. Occasionally, the difference in volume is of a magnitude that the control valve and lines will not efficiently handle the larger volume of exhausted fluid. This creates a back pressure in the exhausted fluid thereby slowing down retraction of the hydraulic jack.

OBJECTS OF THE INVENTION

Accordingly, an object of this invention is to provide an improved fast exhaust circuit for hydraulic jacks.

Another object of this invention is to provide such an improved fast exhaust circuit for selectively minimizing back pressure generated in the fluid exhausted from the hydraulic jack during operation thereof.

Other objects and advantages of the present invention will become more readily apparent upon reference to the accompanying drawing and following description.

BRIEF DESCRIPTION OF THE DRAWING

The sole FIGURE is a schematic drawing of a fast exhaust circuit for hydraulic jacks embodying the principles of the present invention.

DESCRIPTION OF THE PREFERRED EMBODIMENT

Referring more particularly to the drawing, a fast exhaust circuit for hydraulic jacks embodying the principles of the present invention is generally indicated by the reference numeral 10 in association with a pair of hydraulic jacks 11. Each hydraulic jack has a rod 12 attached to a piston 13 slidably disposed within a cylinder 14. A pump 16 draws fluid from a tank 17 and directs pressurized fluid through a supply circuit 18 to a pilot actuated control valve 19. A branch conduit 21 connects the supply conduit to the control valve through a check valve 22 to provide an alternate flow path from the pump to the control valve. A drain conduit 23 and a return conduit 24 connect the control valve with the tank. A pair of conduits 25 and 26 connect the control valve with the head end and rod end, respectively, of the hydraulic jacks 11. A relief valve 27 is interconnected between conduits 18 and 23 to relieve excessive pressure in the hydraulic system.

A pilot pump 31 directs fluid through a line 32 to a manually actuatable selector valve 33. A drain line 34 connects the selector valve with the tank 17. A pair of pilot lines 36 and 37 connect the selector valve with opposite ends of the control valve 19.

A bypass conduit 38 is connected to the conduit 25 adjacent to the hydraulic jacks 11 and communicates with the tank 17. A pilot actuated bypass valve 39 is disposed within the bypass conduit and is normally resiliently positioned for blocking fluid flow therethrough. A pilot line 41 connects the pilot line 36 with one end of the valve 39.

OPERATION

While the operation of the present invention is believed clearly apparent from the foregoing description, further amplification will subsequently be made in the following brief summary of such operation. When the control valve 19 is in the neutral position shown, fluid from the pump 16 passes through the control valve and is returned to the tank through the conduit 24. Likewise, when the selector valve 33 is in the position shown, the fluid output of the pump 31 is returned to the tank through the drain line 34.

Extending the rods 12 of the hydraulic jacks 11 is initiated by shifting the selector valve 33 to the right to direct pilot fluid through the line 37 to shift the control valve 19 to the right. This simultaneously blocks communication between conduits 18 and 24, establishes communication between conduits 21 and 25 and connects the conduit 26 with the drain conduit 23. Thus, fluid from the pump 16 passes through the check valve 22, control valve 19, conduit 25, and into the head ends of the hydraulic jacks causing extension thereof. The fluid exhausted from the rod ends is communicated through conduit 26, control valve 19, and conduit 23 to the tank.

Retraction of the hydraulic jacks 11 is initiated by shifting the selector valve 33 to the left for directing pilot fluid through lines 36 and 41. The control valve 19 and bypass valve 39 are selected so that a relatively higher fluid pressure is required to actuate the bypass valve than that required to actuate the control valve. In the present invention the control valve 19 is modulatably controlled when the pressurized fluid in line 36 is between 50 to 100 psi (3.515 to 7.13 kg/cm$^2$) while the bypass valve 39 is actuated only when the pressure in line 41 exceeds 100 psi (7.13 kg/cm$^2$). Thus by modulating the selector valve to maintain a fluid pressure in the conduits 36 and 41 between 50 and 100 psi the control valve may be shifted to the left while the bypass valve remains in its fluid blocking position. With the control valve shifted to the left, pressurized fluid from the pump 16 is directed through conduit 26 to the rod ends of the hydraulic jacks 11 causing retraction thereof. The fluid exhausted from the head ends of the hydraulic jacks is returned through the conduit 25, the control valve, and conduit 23. Actuating only the control valve for retracting the hydraulic jacks is desirable under certain circumstances particularly when a force is being exerted on the rods 12 tending to retract the jacks. By actuating only the control valve under this condition the retraction of the hydraulic jacks can be precisely modulatably controlled by metering the exhaust fluid through the control valve.

When it is desirable to retract the hydraulic jacks 11 at a faster rate, the selector valve 33 is shift sufficiently to raise the pressure in lines 36 and 41 above 100 psi to shift both the control valve 19 and the bypass valve 39 to the left. As previously described, shifting the control valve to the left directs pressurized fluid through conduit 26 to the rod ends of the hydraulic jacks while communicating conduit 25 with the drain conduit 23.

Shifting the bypass valve to the left establishes direct communication between the head ends of the hydraulic jacks and the tank 17 through the bypass conduit 38 providing a substantially unrestricted flow path for returning a large portion of the fluid exhausted from the head ends of the hydraulic jacks to the tank. A smaller portion of the fluid exhausted from the head ends will continue to be returned to the tank through conduit 25, control valve 19, and conduit 23.

In view of the foregoing, it is readily apparent that the structure of the present invention provides an improved fast exhaust circuit for hydraulic jacks which provides for selectively minimizing back pressure generated in the fluid exhausted from the hydraulic jacks during retraction thereof. This is accomplished by providing a bypass conduit connected to the head ends of the hydraulic jacks with fluid flow through the bypass conduit normally blocked by a bypass valve which is selectively actuatable for returning a portion of the fluid exhausted from the head ends of the hydraulic jacks directly to the tank without passing through the control valve.

While the invention has been described as shown with particular reference to the preferred embodiment, it will be apparent that variations might be possible that would fall within the scope of the present invention which is not intended to be limited except as defined in the following claims.

What is claimed is:

1. A fast exhaust circuit for hydraulic jacks, comprising:

a hydraulic jack having a head end and a rod end;

a source of fluid including a fluid reservoir, a pump, and a conduit communicating the pump with said reservoir;

conduit means for communicating said hydraulic jack with said pump and said reservoir;

a control valve disposed in said conduit means for selectively directing pressurized fluid through said conduit means from said pump to the rod end of said hydraulic jack and transmitting fluid exhausted from the head end of said hydraulic jack to said reservoir;

a bypass conduit connecting said conduit means adjacent to said hydraulic jack with said reservoir; and a fluid pressure actuated bypass valve disposed in said bypass conduit normally positioned for blocking fluid flow therethrough so that all fluid exhausted from the head end of the hydraulic jack passes through and is modulatably controlled by said control valve, said bypass valve being selectively positionable by directing pressurized fluid thereto to establish communication through the bypass conduit for returning a portion of the fluid exhausted from the head end of the hydraulic jack through the bypass valve and the bypass conduit directly to said reservoir bypassing said control valve with said portion of the exhausted fluid passing through the bypass valve being larger than the portion passing through the control valve.

2. The fast exhaust circuit of claim 1 wherein said conduit means includes a first conduit and a second conduit connecting the control valve to the head end and rod end, respectively, of the hydraulic jack, said bypass conduit being connected to said first conduit.

3. The fast exhaust circuit of claim 2 including a manual selector valve, a source of pressurized actuating fluid connected to said selector valve, and a first line connecting said selector valve to said bypass valve, said selector valve being selectively actuatable to direct pressurized actuating fluid from said source to said bypass valve for shifting it to a position establishing fluid communication through said bypass conduit.

4. The fast exhaust circuit of claim 3 wherein said control valve is actuated by pressurized fluid and including a second line communicating said first line with said control valve to transmit pressurized actuating fluid thereto.

5. The fast exhaust circuit of claim 4 wherein said control valve is shifted by pressurized fluid at a predetermined pressure level and said bypass valve is shifted when the pressurized fluid exceeds said predetermined pressure level.

6. A fast exhaust circuit for hydraulic jacks, comprising;

a hydraulic jack having a head end and a rod end;

a source of fluid including a fluid reservoir, a pump and a conduit connecting the pump with said reservoir;

a fluid actuated control valve actuated by pressurized actuating fluid directed thereto at a predetermined pressure level;

means for communicating the control valve with the pump and the reservoir;

a first conduit and second conduit connecting the control valve with the head end and rod end, respectively, of the hydraulic jack;

a bypass conduit connecting the first conduit with said reservoir;

a fluid actuated bypass valve disposed in said bypass conduit normally positioned for blocking fluid flow therethrough so that all fluid exhausted from the head end of the hydraulic jack passes through and is modulatably controlled by said control valve, said bypass valve being selectively positioned to establish communication through the bypass conduit when the pressurized actuating fluid directed thereto exceeds said predetermined pressure level for returning a portion of the fluid exhausted from the head end of the hydraulic jack through the bypass valve and the bypass conduit directly to said reservoir bypassing said control valve with said portion of the exhausted fluid passing through the bypass valve being larger than the portion passing through the control valve;

a pilot pump;

a pilot line connecting said pilot pump with the bypass valve and the control valve; and a selector valve disposed in the pilot line normally positioned for blocking fluid flow therethrough and selectively actuatable to direct pressurized actuating fluid through the pilot line at said predetermined pressure level for actuating said control valve independently of said bypass valve and at a pressure level above said predetermined pressure level for actuating said bypass valve in combination with the actuation of the control valve.

* * * * *